US007384348B2

(12) United States Patent
Lin et al.

(10) Patent No.: US 7,384,348 B2
(45) **Date of Patent: *Jun. 10, 2008**

(54) GOLF CLUB HEAD

(75) Inventors: Chon-Chen Lin, Ping-Tung Hsien (TW); Shun-Fu Hu, Ping-Tung Hsien (TW); Yen-Chi Hsu, Ping-Tung Hsien (TW)

(73) Assignee: O-Ta Precision Industry Co., Inc., Ping-Tung Hsien (TW)

( * ) Notice: Subject to any disclaimer, the term of this patent is extended or adjusted under 35 U.S.C. 154(b) by 8 days.

This patent is subject to a terminal disclaimer.

(21) Appl. No.: 11/476,033

(22) Filed: Jun. 28, 2006

(65) Prior Publication Data

US 2008/0004132 A1 Jan. 3, 2008

(51) Int. Cl.
*A63B 53/04* (2006.01)

(52) U.S. Cl. ..... 473/332; 473/342; 473/346; 473/349

(58) Field of Classification Search ..... 473/324–350, 473/287–292

See application file for complete search history.

(56) References Cited

U.S. PATENT DOCUMENTS 2,846,228 A * 8/1958 Reach ..... 473/332
3,749,408 A * 7/1973 Mills ..... 473/336
3,975,023 A * 8/1976 Inamori ..... 473/329
5,082,278 A * 1/1992 Hsien ..... 473/242
5,195,747 A * 3/1993 Choy ..... 473/333
5,316,298 A * 5/1994 Hutin et al. ..... 473/332
5,409,229 A * 4/1995 Schmidt et al. ..... 473/332
5,586,947 A * 12/1996 Hutin ..... 473/324
5,595,552 A * 1/1997 Wright et al. ..... 473/332
5,697,855 A * 12/1997 Aizawa ..... 473/350
5,707,302 A * 1/1998 Leon et al. ..... 473/324
5,993,331 A * 11/1999 Shieh ..... 473/342
6,379,262 B1 * 4/2002 Boone ..... 473/324
6,688,989 B2 * 2/2004 Best ..... 473/332
6,743,117 B2 * 6/2004 Gilbert ..... 473/332
6,840,872 B2 * 1/2005 Yoneyama ..... 473/346
6,849,005 B2 * 2/2005 Rife ..... 473/350
6,899,638 B2 * 5/2005 Iwata et al. ..... 473/329
7,070,513 B2 * 7/2006 Takeda et al. ..... 473/329
2007/0026965 A1 * 2/2007 Huang ..... 473/342
2007/0117653 A1 * 5/2007 Yoneyama ..... 473/350

FOREIGN PATENT DOCUMENTS

JP 2001-353242 * 12/2001
JP 2003-245384 * 9/2003

* cited by examiner

*Primary Examiner*—Sebastiano Passaniti
(74) *Attorney, Agent, or Firm*—Foley & Lardner LLP

(57) ABSTRACT

A golf club head includes a head body having a front opening, a striking plate member, and a vibration-absorbing plate member. The striking plate member covers the front opening, and has a front striking face with a striking zone, and a ring projecting rearwardly from a rear side of the striking plate member and defining an indentation. The vibration-absorbing plate member is fixed in the indentation.

6 Claims, 6 Drawing Sheets

GOLF CLUB HEAD

BACKGROUND OF THE INVENTION

1. Field of the Invention

The invention relates to a golf club head, more particularly to a golf club head that has a good vibration-absorbing effect.

2. Description of the Related Art

Referring to FIGS. 1 and 2, a conventional golf club head 1 includes a head body 11 having a front opening 111, and a striking plate 12 covering the front opening 111 for striking a golf ball (not shown). Since the conventional golf club head 1 is not provided with a vibration-absorbing element, when a player strikes the ball with a large swinging force, a substantial impact force is absorbed by the striking plate 12, such that an intense vibration is produced. This intense vibration can make it difficult to hit the ball accurately. Further, the intense vibration is transmitted to the player's hands which may bring discomfort to the player. Such transmission of vibration may be especially acute when the player is using a wood.

Referring to FIG. 3, another conventional golf club head 2, as disclosed in Taiwanese Patent No. M240256, includes a head body 21, and a striking plate 22 fixed to a front end face of the head body 21. A receiving space 23 is formed in a bottom portion of the head body 21 adjacent to the striking plate 22. Fluid 24 is filled into the receiving space 23 to serve as a vibration-absorbing element. The fluid 24 in the receiving space 23 produces a viscous force that dampens the vibration produced during striking of the ball.

Although the conventional golf club head 2 of FIG. 3 can achieve a vibration-absorbing effect, the fluid 24 may leak out from the receiving space 23 during use of the golf club head 2 over time. Further, such a configuration of the conventional golf club head 2 is difficult to produce, so that the cost to produce the same is high. Moreover, during swinging of a golf club incorporating the golf club head 2, because of the movement of the fluid 24 in the receiving space 23, a delayed condition is produced, which reduces stability during hitting of the ball.

SUMMARY OF THE INVENTION

Therefore, the object of the present invention is to provide a golf club head that can absorb vibration during hitting of a golf ball so that a player can control stably a striking direction of the golf ball and so that any feelings of discomfort given to the player as a result of receiving the transmission of vibration can be reduced.

According to this invention, a golf club head comprises a head body having a front opening, a striking plate member, and a vibration-absorbing plate member. The striking plate member covers the front opening, and has a front striking face with a striking zone, and a ring projecting rearwardly from a rear side of the striking plate member and defining an indentation. The vibration-absorbing plate member is fixed in the indentation.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
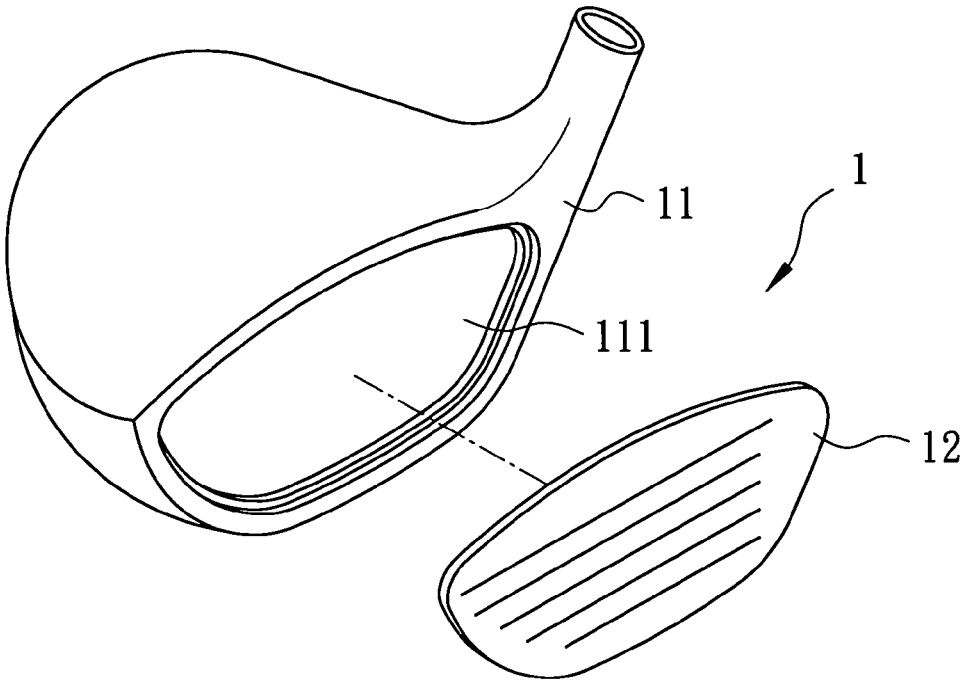
FIG. 1 PRIOR ART
FIG. 1 is an exploded perspective view of a conventional golf club head.
Figure 2:
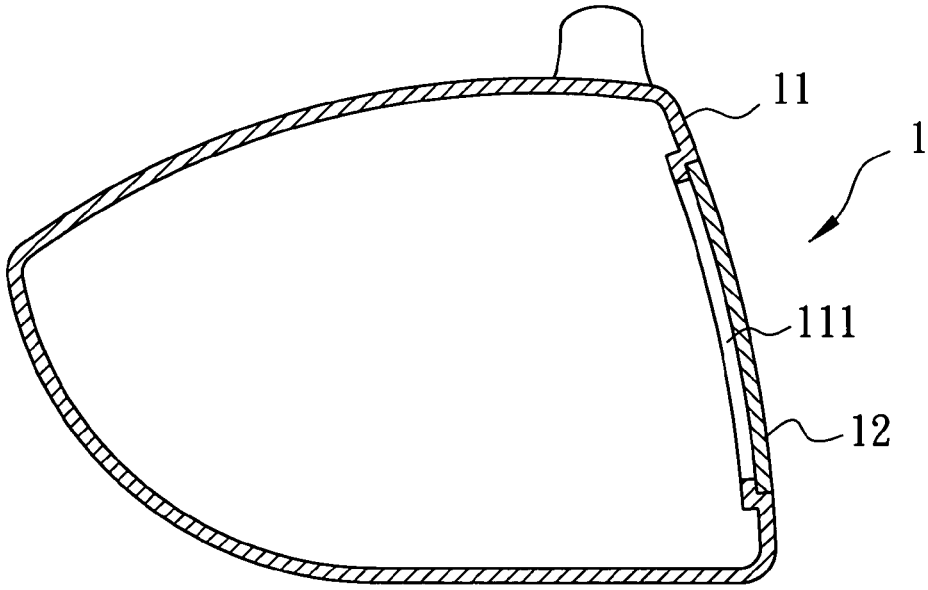
FIG. 2 PRIOR ART
FIG. 2 is an assembled sectional view of the conventional golf club head of FIG. 1.
Figure 3:
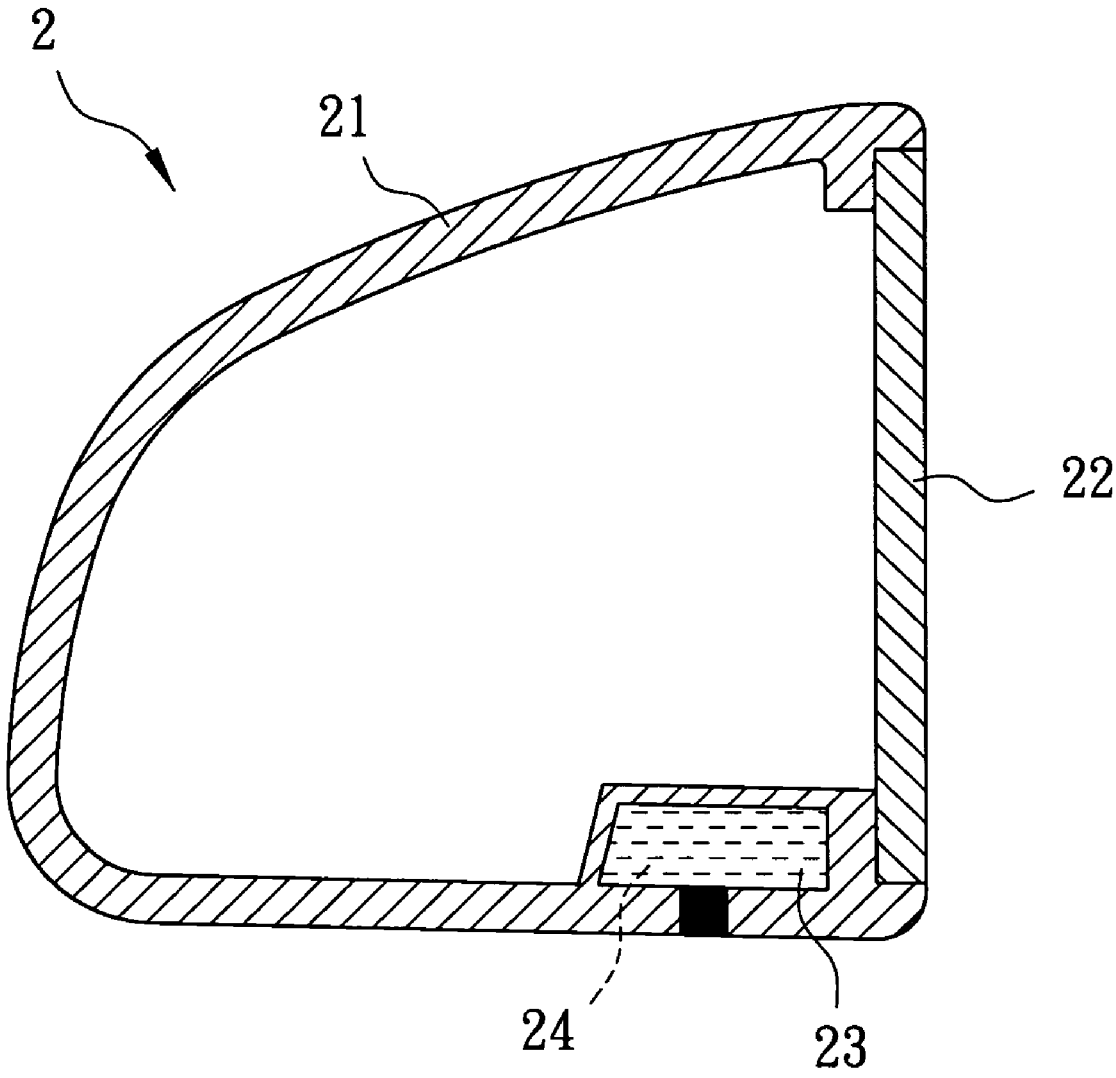
FIG. 3 PRIOR ART
FIG. 3 is an assembled sectional view of a conventional golf club head disclosed in Taiwanese Patent No. M240256.

Before the present invention is described in greater detail, it should be noted that like elements are denoted by the same reference numerals throughout the disclosure.

Figure 4:
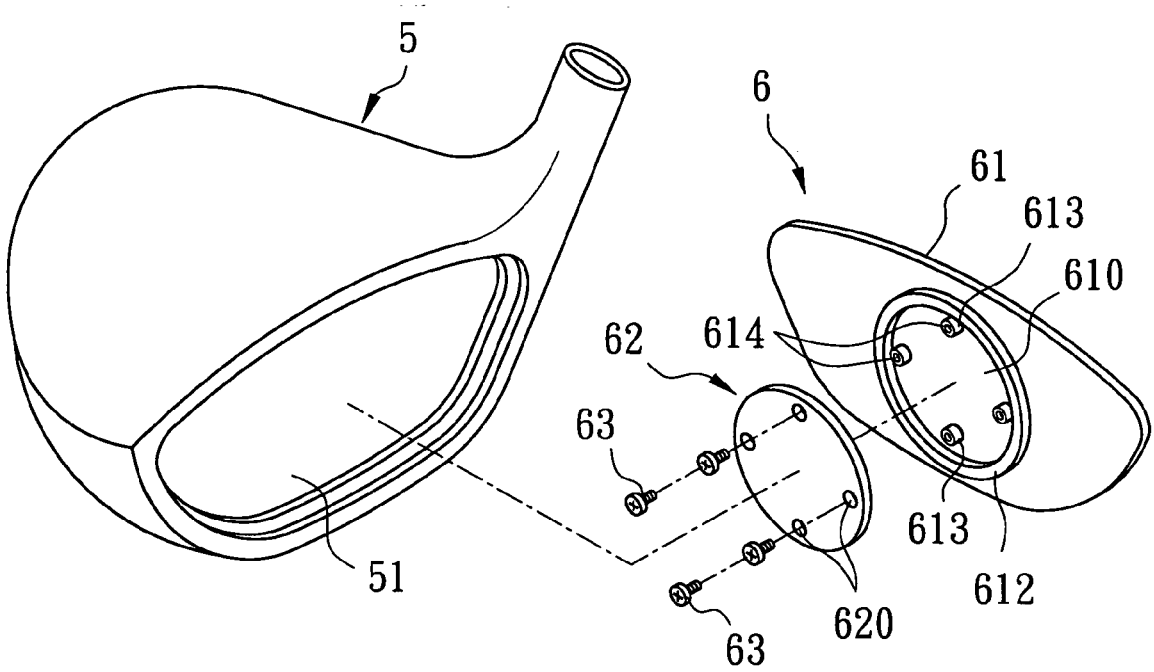
FIG. 4 is an exploded perspective view of the first preferred embodiment of a golf club head according to the present invention.
Figure 5:
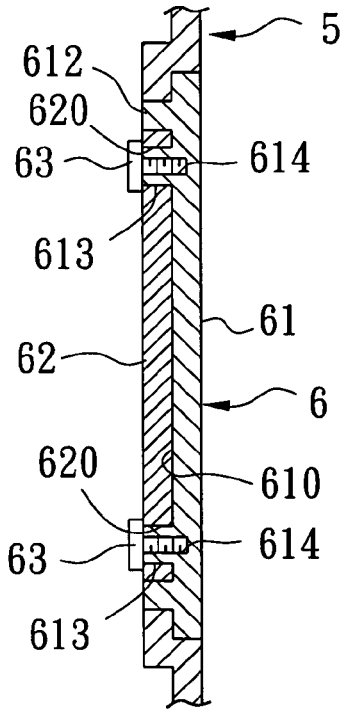
FIG. 5 is a sectional view of the first preferred embodiment in an assembled state.

Referring to FIGS. 4 and 5, the first preferred embodiment of a golf club head according to the present invention is adapted to be applied to a wood, and is shown to comprise a head body 5 having a front opening 51, a striking plate member 6, and a vibration-absorbing plate member 62.

The striking plate member 6 covers the front opening 51 of the head body 5, is made of a titanium alloy, and has a thickness of about 0.5 mm. The striking plate member 6 further has a front striking face 61 with a striking zone, and a ring 612 projecting rearwardly from a rear side of the striking plate member 6 and defining an indentation 610. The ring 612 is located behind the striking zone of the striking face 61.

The vibration-absorbing plate member 62 is fixed in the indentation 610, is made of a carbon fiber plastic material, and has four angularly spaced-apart through holes 620.

A fastening unit is provided to fix the vibration-absorbing plate member 62 in the indentation 610 of the striking plate member 6. The fastening unit includes four fasteners 63, in the form of screws, and four angularly spaced-apart studs 613 projecting rearwardly from the rear side of the striking plate member 6 within the ring 612 and extending respectively through the through holes 620. Each of the studs 613 has an internal screw hole 614. The fasteners 63 are engaged threadedly and respectively to the internal screw holes 614 in the studs 613 after the studs 613 extend through the through holes 620, respectively, thereby securing the vibration-absorbing plate member 62 in the indentation 610.

When the golf club head of the present invention strikes the golf ball, the vibration produced when the striking face 61 hits the golf ball is directly and effectively absorbed by the vibration-absorbing plate member 62, such that the vibration that is transferred to the player's hands is minimized. As a result, any feelings of discomfort given to the player are reduced, and the player can stably and accurately strike the golf ball in a desired direction.

Figure 6:
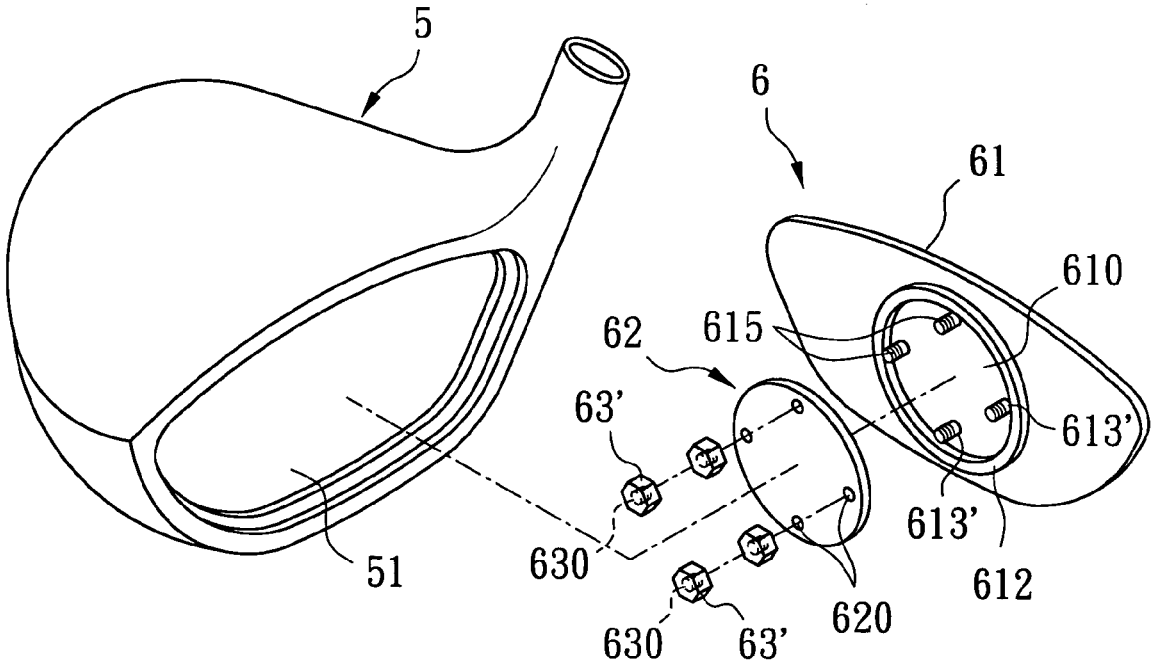
FIG. 6 is an exploded perspective view of the second preferred embodiment of a golf club head according to the present invention.
Figure 7:
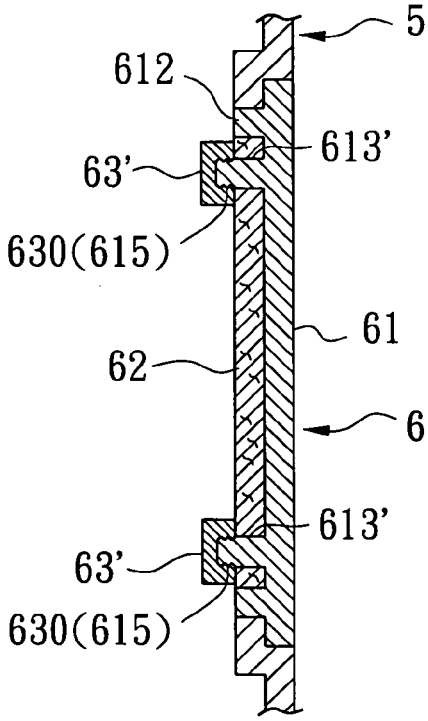
FIG. 7 is a sectional view of the second preferred embodiment in an assembled state.

Referring to FIGS. 6 and 7, the second preferred embodiment of a golf club head according to the present invention is shown to be similar to the first preferred embodiment. However, in this embodiment, each of the studs 613' has an external thread 615 extending through a respective one of the through holes 620 in the vibration-absorbing plate member 62. Each of the fasteners 63' has an internal thread 630 engaged respectively to the external thread 615 of the respective stud 613' after each stud 613' extends through the respective through hole 620, thereby securing the vibration-absorbing plate member 62 in the indentation 610 of the ring 612. Each fastener 63' is in the form of a cap. Alternatively, each fastener 63' may be in the form of a nut.

Although the studs 613' are located within the ring 612 in this embodiment, they may project rearwardly from the ring 612 in an alternative embodiment, so that the studs 613' are located between the ring 612 and the vibration-absorbing plate member 62. By slightly altering the configuration of the vibration-absorbing plate member 62, the vibration-absorbing plate member 62 can be similarly fixed in the indentation 610 of the ring 612.

Figure 8:
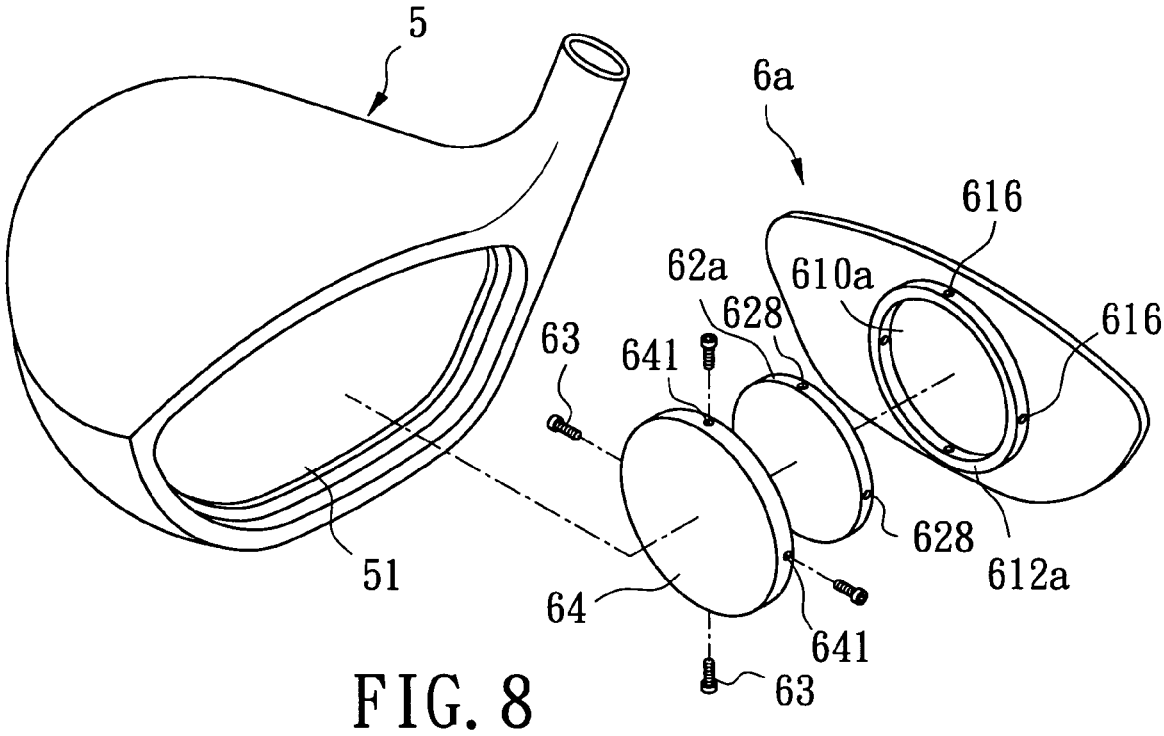
FIG. 8 is an exploded perspective view of the third preferred embodiment of a golf club head according to the present invention.
Figure 9:
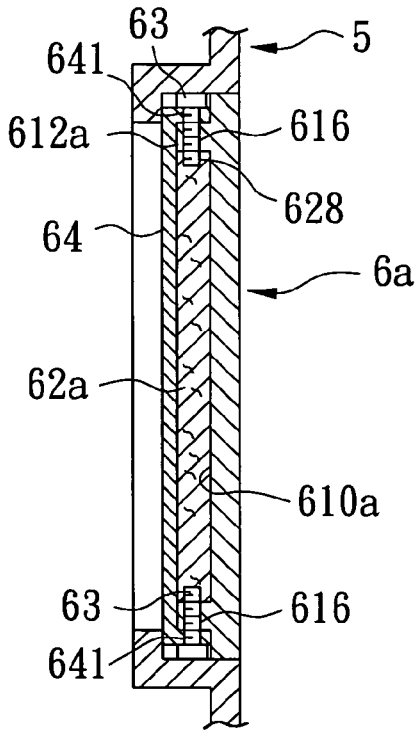
FIG. 9 is a sectional view of the third preferred embodiment in an assembled state.

Referring to FIGS. 8 and 9, the third preferred embodiment of a golf club head according to the present invention is shown to be similar to the first preferred embodiment. However, in this embodiment, the striking plate member (6*a*) further has a cover plate 64 secured to the ring (612*a*) and covering the vibration-absorbing plate member (62*a*). The cover plate 64 is formed with four angularly spaced-apart radial through holes 641. The ring (612*a*) is also formed with four angularly spaced-apart radial through holes 616. The vibration-absorbing plate member (62*a*) is formed with four angularly spaced-apart radial screw holes 628. Each of the fasteners 63 extends through one of the radial through holes 641 in the cover plate 64 and the corresponding radial through hole 616 in the ring (612*a*), and engages the corresponding radial screw hole 628 in the vibration-absorbing plate member (62*a*), thereby securing the vibration-absorbing plate member (62*a*) in the indentation (610*a*) of the ring (612*a*). The fasteners 63 are configured as screws. In addition, the number of the fasteners 63 used in this embodiment is not limited to that described and shown, and may be varied as deemed necessary as long as the vibration-absorbing plate member (62*a*) is stably fixed in the indentation (610*a*) of the ring (612*a*).

Figure 10:
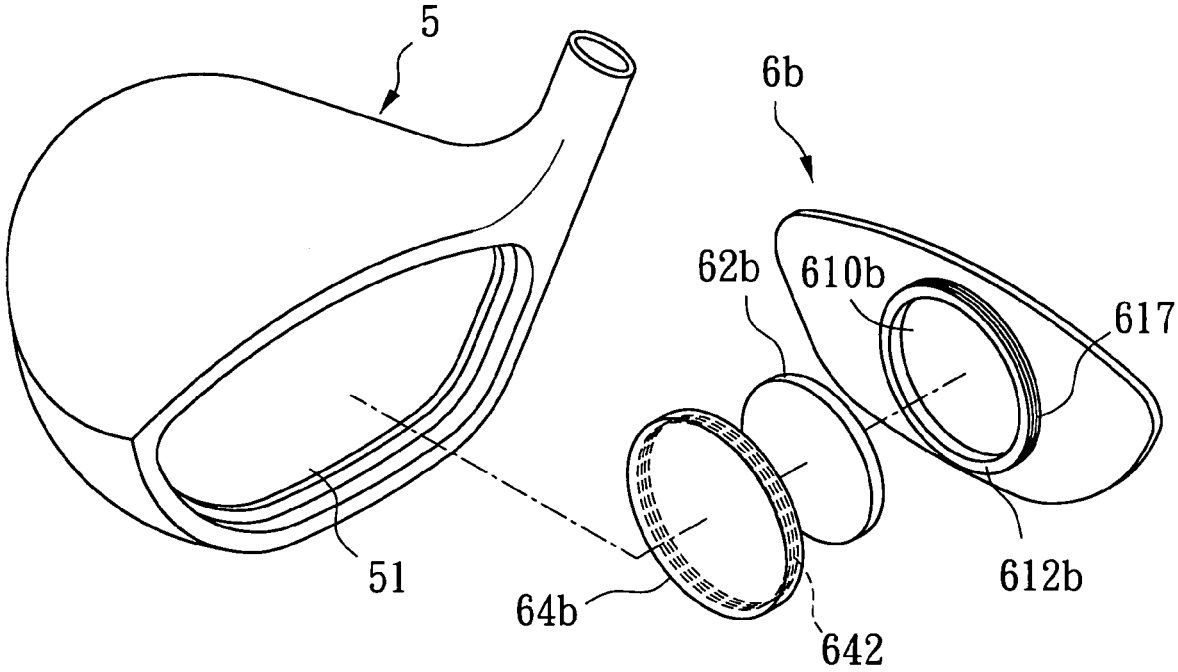
FIG. 10 is an exploded perspective view of the fourth preferred embodiment of a golf club head according to the present invention.
Figure 11:
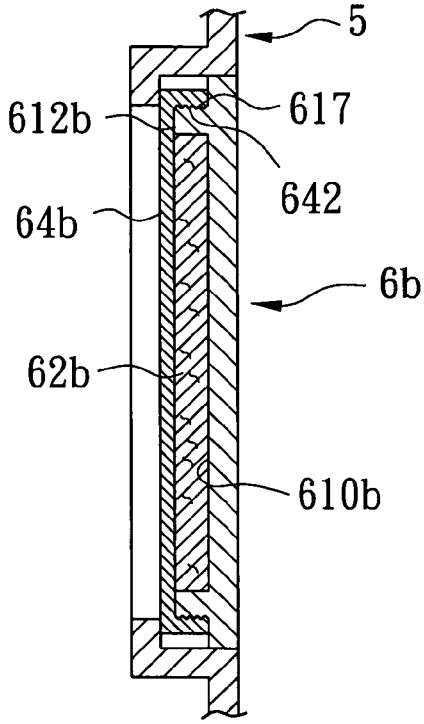
FIG. 11 is a sectional view of the fourth preferred embodiment in an assembled state.

Referring to FIGS. 10 and 11, the fourth preferred embodiment of a golf club head according to the present invention is shown to be similar to the third preferred embodiment. However, in this embodiment, the fastening unit includes an external thread 617 formed on an outer peripheral face of the ring (612*b*), and an internal thread 642 formed on the cover plate (64*b*) to engage the external thread 617 of the ring (612*b*). By rotating the cover plate (64*b*) relative to the ring (612*b*), the vibration-absorbing plate member (62*b*) can be secured in the indentation (610*b*) of the ring (612*b*).

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A golf club head comprising:

a head body having a front opening;

a striking plate member covering said front opening, and having a front striking face with a striking zone, and a ring projecting rearwardly from a rear side of said striking plate member and defining an indentation;

a vibration-absorbing plate member fixed in said indentation; and a fastening unit to fix said vibration-absorbing plate member in said indentation;

wherein said fastening unit includes a plurality of angularly spaced-apart studs projecting rearwardly from said rear side, and a plurality of fasteners, said vibration-absorbing plate member having a plurality of spaced-apart through holes to receive respectively said studs, said fasteners being fixed respectively to said studs after said studs extend through said through holes, respectively.

2. The golf club head of claim 1, wherein each of said studs has an internal screw hole to engage a respective one of said fasteners.

3. The golf club head of claim 1, wherein each of said studs has an external thread extending through a respective one of said through holes in said vibration-absorbing plate member to engage a respective one of said fasteners.

4. The golf club head of claim 1, wherein said striking plate member is made of a titanium alloy, and said vibration-absorbing plate member is made of a carbon fiber plastic material.

5. A golf club head comprising:

a head body having a front opening;

a striking plate member covering said front opening, and having a front striking face with a striking zone, and a ring projecting rearwardly from a rear side of said striking plate member and defining an indentation;

a vibration-absorbing plate member fixed in said indentation; and a fastening unit to fix said vibration-absorbing plate member in said indentation;

wherein said striking plate member further has a cover plate secured to said ring and covering said vibration-absorbing plate member; and wherein said ring is formed with a plurality of angularly spaced-apart radial through holes, said fastening unit including a plurality of fasteners each extending into said cover plate and said vibration-absorbing plate member through one of said radial through holes.

6. A golf club head comprising:

a head body having a front opening;

a striking plate member covering said front opening, and having a front striking face with a striking zone, and a ring projecting rearwardly from a rear side of said striking plate member and defining an indentation;

a vibration-absorbing plate member fixed in said indentation; and a fastening unit to fix said vibration-absorbing plate member in said indentation;

wherein said striking plate member further has a cover plate secured to said ring and covering said vibration-absorbing plate member; and wherein said fastening unit includes an external thread formed on an outer peripheral face of said ring, and an internal thread formed on said cover plate to engage said external thread of said ring.

* * * * *